United States Patent [19]

Kondo

[11] 4,107,916

[45] Aug. 22, 1978

[54] ELECTRONIC WATCH HAVING AN ALARM MEANS

[75] Inventor: Kenichi Kondo, Tokyo, Japan

[73] Assignee: Kabushiki Kaisha Daini Seikosha, Japan

[21] Appl. No.: 734,431

[22] Filed: Oct. 21, 1976

[30] Foreign Application Priority Data

Oct. 28, 1975 [JP] Japan ..... 50-129578
Oct. 28, 1975 [JP] Japan ..... 50-129579

[51] Int. Cl.[2] ..... G04C 21/00; G04B 23/06; G04B 23/12

[52] U.S. Cl. ..... 58/38 R; 58/16.5; 58/19 R; 58/57.5

[58] Field of Search ..... 58/16.5, 18, 38, 57.5, 58/152 B, 19

[56] References Cited

U.S. PATENT DOCUMENTS 3,834,153 9/1974 Yoda ..... 58/38 R
3,946,549 3/1976 Cake ..... 58/38 R

*Primary Examiner*—Edith S. Jackmon
*Attorney, Agent, or Firm*—Robert E. Burns; Emmanuel J. Lobato; Bruce L. Adams

[57] ABSTRACT

An electronic alarm watch having a plurality of memories each for storing an alarm time for producing an alarm signal when an alarm time reached. A single alarm channel produces an alarm signal at a set time and after the first occurrence of the alarm signal no further alarm signal occurs at the set time. A recurring alarm channel produces an alarm signal at every occurrence of an alarm of that channel.

5 Claims, 2 Drawing Figures

ELECTRONIC WATCH HAVING AN ALARM MEANS

BACKGROUND OF THE INVENTION

This invention relates to an electronic watch having an alarm means.

In the conventional electronic alarm watch, generally an alarm signal is first at a set alarm time and is again produced each time the set time occurs, so that these electronic alarm watches are convenient to use when alarms are need at the specified same time every day, but if only one alarm is needed they require one to clear the contents of time setting circuitry by a manual switch. In the multi-alarm electronic watch which is able to be set to a plurality of alarm times, it becomes more convenient to provide another channel which can be automatically cleared of the time set in the specified channel so as not to produce an alarm signal at the setting time again and also be able to select any suitable channel if necessary. But such a multi-alarm electronic watch able to reset automatically the alarm time has not yet been developed.

OBJECT OF THE INVENTION

The object of the present invention is to provide an electronic alarm watch with more than one alarm channel including one which is able to clear the alarm time after producing an alarm once so as not to produce alarms again by detecting coincidence of present time with alarm time whether for the single alarm time or a recurrent alarm time and resetting only a memory circuit for the specified channel at the single alarm time.

SUMMARY OF THE INVENTION

According to the present invention, there is provided an electronic watch having alarm means, and having a plurality of memories able to be set to a respective alarm time and multi-channels for producing an alarm signal when a set alarm time reached. A single alarm channel produces an alarm signal after produced once at a set alarm time, and a recurrence alarm channel produces an alarm signal every time a set alarm time occurs.

BRIEF DESCRIPTION OF THE DRAWINGS

The above mentioned and further objects, features and advantages of the present invention will become more apparent from the following description when taken in connection with the accompanying drawings, which show one preferred embodiment of the present invention and wherein.

DESCRIPTION OF THE PREFERRED EMBODIMENT

Figure 1:
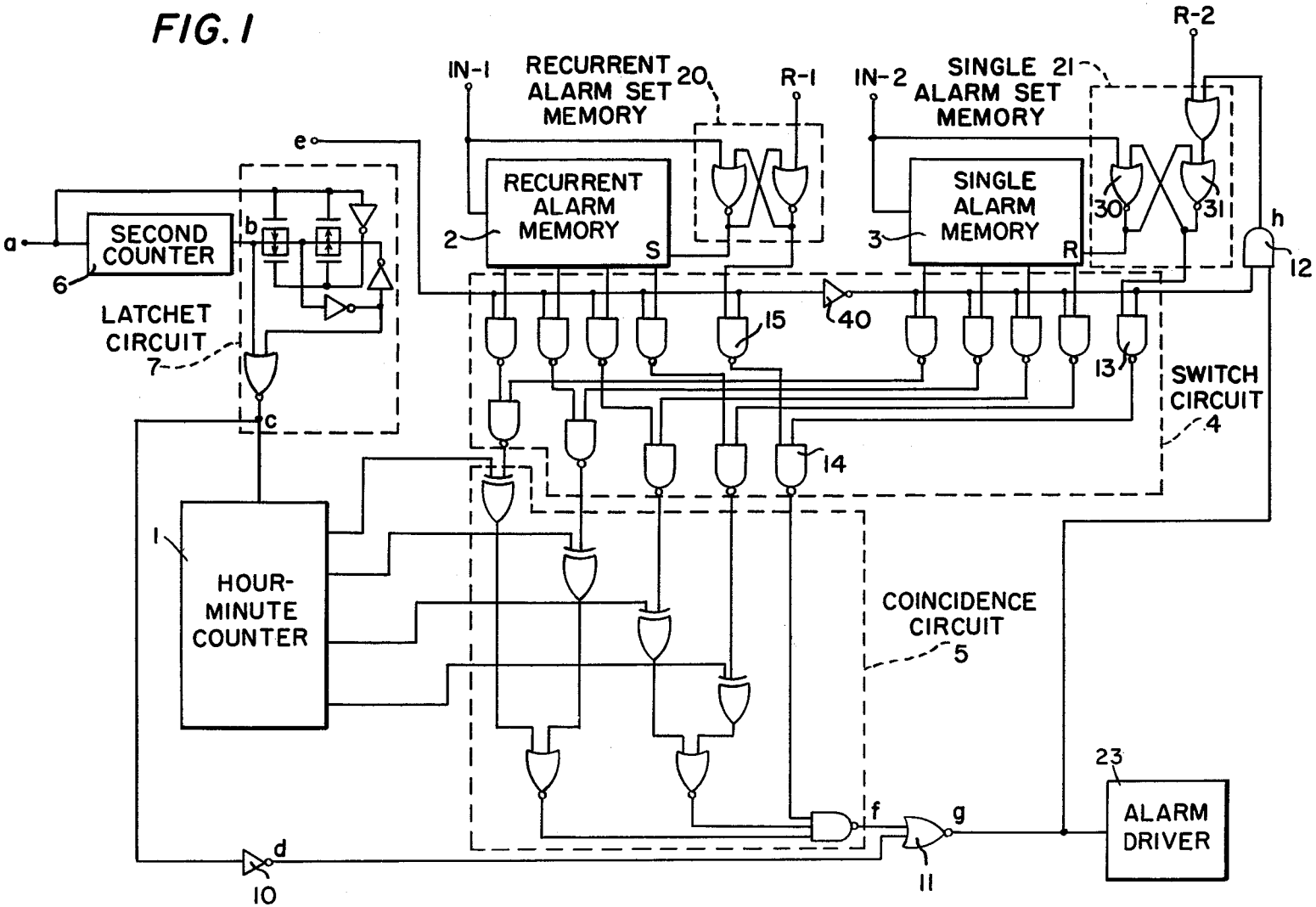
FIG. 1 shows a schematic diagram of an electronic alarm watch according to the present invention.

This invention relates to an electronic watch having an alarm means, and especially having a plurality of memories able to store a time and multi-channels for producing an alarm when a set or stored time is reached, further and also having a single alarm channel for producing an alarm signal at a set time and for producing no alarm signal after having produced said alarm signal at the set time on the first occasion, and further having a recurrence alarm channel for producing an alarm signal at each occurrence of a set time.

The embodiment of the present invention illustrated in the accompanying drawings includes: a second counter 6 and a hour-minute counter 1 for counting time, a recurrent alarm memory 2, a recurrent alarm set memory 20 for memorizing an alarm time, a single alarm memory 3, a single alarm set memory 21, a detecting circuit 12 for detecting coincidence of present time with the single alarm times a switch circuit 4 for transmitting the set or alarm time in a respective one of the said memories 2 and 3, to the coincidence circuit 5 for detecting coincidence between the contents of the hour-minute counter 1 with the content of the respective one of said memories 2 and 3, and an alarm driver 23.

The described embodiment of the present invention operates as follows: Oscillating output signal produced by a quartz oscillator is divided to an 1-Hz signal "*a*" and this signal "*a*" is a input to the second counter 6. Output of the counter 6 is a single pulse signal "*b*" having one minute cycle and is shaped into a single pulse signal "*c*" having a 500 millisecond width by a latch circuit 7, and this signal "*c*" is an input to the hour-minute counter 1 for counting time. The recurrent alarm memory 2 and the single alarm memory 3 may comprise counters the same as the hour-minute counter 1, so that these memories can be set to any desired time by inputting a clock signal to the terminals IN-1 and IN-2. At the same time, said input signal of the terminal IN-1 and IN-2 is also applied to the set-terminals of the recurrent alarm set memory 20 and the single alarm set memory 21 respectively, and therefore these set memories 20 and 21 memorize the existence of a set condition in which a time has been set in memories 2 and 3 respectively.

Figure 2:
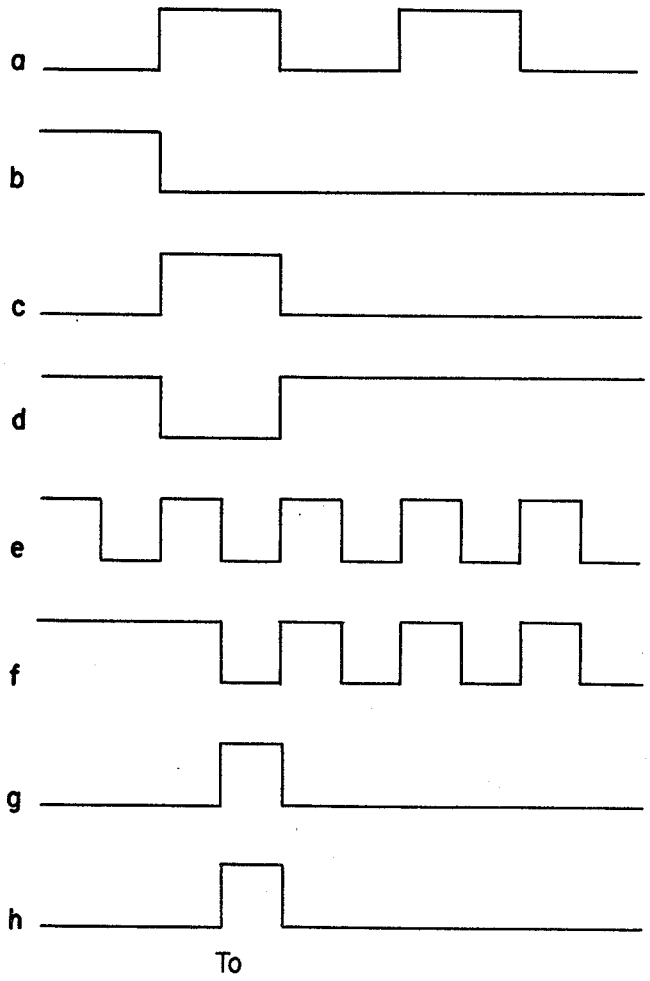
FIG. 2 shows waveforms developed during operation of the present invention.

A signal "*e*" is a sampling signal for dividing output signals of the recurrent alarm memory 2 and the single alarm memory 3, and is a 2Hz output signal from a dividing circuit. The switch circuit 4 may comprise NAND circuits as shown or transmission gates for dividing and transmitting the counter output signals. Then, output of the switch circuit 4 is applied together with the output of the hour-minute counter 1 to the coincidence circuit 5 for detecting coincidence of the set time with the hour-minute counter 1 time. The coincidence circuit 5 is comprised of exclusive OR circuits, NOR circuits and a NANd circuit. Therefore, the output of the coincidence circuit 5 changes to a low-level only when coincidence between the hour-minute counter 1 output and the recurrent or single alarm memory 2 or 3 output is detected, but it is always a high-level when no coincidence is detected. The waveform of this signal "*e*" is shown in FIG. 2.

For example, when an alarm time in the single alarm memory 3 just coincides with the hour-minute counter 1 time at time TO, output of the coincidence circuit 5 changes to a low-level from a high level and produces a pulse signal "*f*" which alternates between the low level and a high level caused by non-coincidence of the hour-minute counter 1 time with the recurrent alarm memory 2 time. Thereupon, the signal "*c*" is inverted by a inverter 10 to produce a signal "*d*" and this signal "*d*" together with the signal "*f*" also produces a pulse signal "*g*" having a narrow width by a NOR circuit 11. This single pulse signal "*g*" is transmitted to the alarm driver 23 for producing an alarm. Then the said alarm trigger signal "*g*" is applied input to an input of the coincidence detecting circuit 12. The other input of the said coincidence detecting circuit 12, which is comprised of an AND circuit, is an inverted signal derived from the sampling pulse signal "*e*" by a inverter 40. Therefore, the output of the detecting circuit 12 is a single pulse such as "*h*" and is developed only when the counter 1 time or present time coincides with the single alarm memory 3 time. When coincidence between present time and the recurrent alarm memory 2 time is detected, the detecting circuit 12 does not produce any output signal *h*. This signal "*h*" is a reset input of the single alarm set memory 21. Since the output of a NOR-circuit 30 is connected to the reset terminal of the single alarm memory 3, all contents of the memory 3 are cleared and the memory time is set at 0 o'clock 00 minute. On the other hand, the output of a NOR circuit 31 is maintained at a low-level and, therefore the output of a reset-detecting circuit 13 in the switch circuit 4 is always at a high level during detection of coincidence of present time with the single alarm memory 3 time and the output of the reset-detecting circuit 13 is inverted by a NAND circuit 14, so that output "*f*" of the coincidence circuit 5 changes to a high level and thereafter does not cause an alarm. And if the hour-minute counter 1 time becomes 0 o'clock 00 minute again, no alarm is produced because the coincidence signal is not developed by the reset detecting circuit 13. However, in order to set again a new desired alarm time by inputting a clock signal to the input terminal IN-2 of the single alarm memory 3, the single alarm set memory 21 is also set and is maintained set and an alarm is produced when the new alarm time is reached. The content of the recurrent alarm memory 2 can be cleared by applying one pulse to the reset terminal R-1 of the recurrent alarm set memory 20 with a manually operated switch. And also when one wishes to manually reset the single alarm, this can be accomplished by applying one pulse to the reset terminal R-2 with a manually operated switch.

As mentioned above, the alarm time for a respective channel can be compared for coincidence with the present time in a time-multiplex mode by using one coincidence circuit in common in spite of having plurality of channels. Therefore simplification of the circuit structure can be attained. And by using one AND circuit for detecting synchronization between the sampling pulse signal and the alarm driving signal it can be easily and simply determined that the coincidence detection be performed whether with the recurrent alarm or with the single alarm.

Furthermore, this invention has the feature that an alarm is not produced even at 0 o'clock 00 minute which corresponds to the content of a cleared memory.

What we claim is:

1. In an electronic alarm watch: a counter for counting a repetitive time signal and for developing a count representative of present time; a first alarm memory for storing a signal representing a first alarm time; a second alarm memory for storing a signal representing a second alarm time; a coincidence detecting circuit connected to receive the contents of said counter for comparing the contents of said counter with another signal applied to said coincidence detecting circuit and for developing an output signal when the compared signals coincide; means for alternately applying the signal stored in said first memory and the signal stored in said second memory to said coincidence detecting circuit to effectuate alternate comparison of the respective signals stored in the memories and the count representative of present time; alarm means responsive to the output of said coincidence detecting circuit for emitting an alarm signal when an alarm time and the present time coincide; and means responsive to the output of said coincidence detecting circuit for clearing said first memory after coincidence between the present time and said first alarm time is detected and for rendering said coincidence detecting circuit ineffective to develop an output signal when the present time passes through zero hours and zero minutes corresponding to the contents of said cleared first memory.

2. In an electronic alarm watch according to claim 1, wherein said means for alternately applying is comprised of: a first array of two-input NAND gates having respective first inputs for receiving respective output signals of said first memory; a second array of two-input NAND gates having respective first inputs for receiving respective output signals of said second memory; a third array of two-input NAND gates; means for applying an output signal from each NAND gate of said first array to a first input of a respective NAND gate of said third array and for applying an output signal from each NAND gate of said second array to the second input of a respective NAND gate of said third array; wherein an intermittant signal applied to the second input of each NAND gate in said first array is effective to intermittently enable the NAND gates of said first array to develop the output signals of said first memory as respective output signals of the NAND gates of said first array and apply the same to said third array which in turn develops the output signals of said first memory as output signals of said third array; and an inverter receptive of the intermittent signal applied to said first array of NAND gates for inverting said intermittent signal and connected to apply the same to the second inputs of the NAND gates comprising said second array for intermittently enabling the same when said first array of NAND gates is not enabled to develop the output signals of said second memory as output signals of said third array of NAND gates alternating with the output signals of said first memory.

3. In an electronic alarm watch according to claim 1, wherein said first memory is responsive to a reset signal to clear the contents thereof, and wherein said means for clearing is comprised of: a flip-flop responsive to an input signal for developing a reset signal and connected to apply said reset signal to said first memory to reset the same; and means responsive to the output signal developed by said coincidence detecting circuit at said first alarm time for applying an input signal to said flip-flop to reset the same and clear said memory.

4. In an electronic alarm watch according to claim 1, wherein said coincidence detecting circuit includes: a three-input NAND gate for developing the output signal of said coincidence detecting circuit, wherein two receive signals representative of time coincidence and the third input receives an output signal of said means for clearing which is low when said first memory is cleared so that said three-input NAND gate cannot develop an output signal when present time passes through zero hours and zero minutes.

5. In an electronic alarm watch according to claim 1, further comprising: means unresponsive to the output signal of said coincidence detecting circuit and manually operable for clearing said second memory so that an alarm signal is emitted each time that present time coincides with the second alarm time until said second memory is cleared by said manually operable means for clearing.

* * * * *